US009717308B2

(12) United States Patent
Bowerman

(10) Patent No.: US 9,717,308 B2
(45) Date of Patent: Aug. 1, 2017

(54) CLASP

(71) Applicant: James Patrick Bowerman, Savannah, GA (US)

(72) Inventor: James Patrick Bowerman, Savannah, GA (US)

( * ) Notice: Subject to any disclaimer, the term of this patent is extended or adjusted under 35 U.S.C. 154(b) by 45 days.

(21) Appl. No.: 14/355,887

(22) PCT Filed: Nov. 2, 2012

(86) PCT No.: PCT/US2012/063244
§ 371 (c)(1),
(2) Date: May 2, 2014

(87) PCT Pub. No.: WO2013/067303
PCT Pub. Date: May 10, 2013

(65) Prior Publication Data

US 2014/0301672 A1 Oct. 9, 2014

Related U.S. Application Data

(66) Substitute for application No. 61/628,740, filed on Nov. 4, 2011.

(51) Int. Cl.
*A44B 11/02* (2006.01)
*A45C 7/00* (2006.01)
(Continued)

(52) U.S. Cl.
CPC ..... *A44B 11/02* (2013.01); *A45C 7/0086* (2013.01); *A45F 3/04* (2013.01); *A44B 17/0041* (2013.01);
(Continued)

(58) Field of Classification Search
CPC ..... A44B 11/02; A44B 17/0041; A45C 13/10; A45C 7/0086; A45F 3/04; Y10T 24/44017
(Continued)

(56) References Cited

U.S. PATENT DOCUMENTS 567,198 A * 9/1896 Richardson ..... A41F 1/00 24/670
710,123 A * 9/1902 Stearn ..... A41F 1/00 2/218
(Continued)

FOREIGN PATENT DOCUMENTS

JP 7-43650 U 9/1995
JP 11-244024 A 9/1999
KR 20100003124 U 3/2010

OTHER PUBLICATIONS

International Search Report issued Mar. 27, 2013 re: PCT/US2012/063244; citing: U.S. Pat. No. 6,510,592 B1, U.S. Pat. No. 4,704,772 A, KR 20-2010-0003124 U, JP 07-043650 U and JP 11-244024 A.
(Continued)

*Primary Examiner* — David Upchurch
(74) *Attorney, Agent, or Firm* — Blank Rome LLP

(57) ABSTRACT

A clasp including a protrusion portion with a protrusion, and a receiving portion defining a receiving cavity configured to receive the protrusion portion is described. The protrusion is securable in the cavity via frictional fitting of the protrusion into the cavity. The frictional fitting of the protrusion into the cavity creates a secure association between the receiving portion and the protrusion portion, and the receiving portion includes a first arm and a second arm extending from a receiving portion base. The first arm includes a first arcuate recess and the second arm includes a second arcuate recess opposing the first arcuate recess, and the first arcuate recess and the second arcuate recess define adjustable width of the cavity.

9 Claims, 11 Drawing Sheets

(51) Int. Cl.
*A45F 3/04* (2006.01)
*A45C 13/10* (2006.01)
*A44B 17/00* (2006.01)

(52) U.S. Cl.
CPC ..... *A45C 13/10* (2013.01); *Y10T 24/44017* (2015.01)

(58) Field of Classification Search
USPC ..... 24/629
See application file for complete search history.

(56) References Cited

U.S. PATENT DOCUMENTS 1,507,216 A * 9/1924 Stockton ..... A41F 1/00 24/595.1
1,890,692 A * 12/1932 Mosgrove ..... A41F 3/02 24/668
1,916,010 A * 6/1933 Mosgrove ..... A41F 3/02 24/668
4,270,247 A * 6/1981 Freedom ..... A45D 8/34 24/115 A
4,704,772 A 11/1987 Kasai
4,805,870 A * 2/1989 Mertz ..... H01F 7/1607 251/129.15
4,923,272 A * 5/1990 Cuda ..... G02B 6/389 385/55
5,704,100 A * 1/1998 Swan ..... F16B 21/186 24/546
5,706,561 A * 1/1998 Kipperman ..... A41F 11/04 24/666
6,070,309 A * 6/2000 Wong ..... A41F 3/02 24/668
6,254,163 B1 * 7/2001 Schofield ..... B60N 2/015 248/222.11
6,510,592 B1 1/2003 Hamilton
7,216,404 B1 * 5/2007 Doyle ..... A45F 5/02 206/286
7,704,008 B2 * 4/2010 Shinozaki ..... F16B 21/186 24/567

OTHER PUBLICATIONS

Written Opinion issued Mar. 27, 2013 re: PCT/US2012/063244; citing: U.S. Pat. No. 6,510,592 B1, U.S. Pat. No. 4,704,772 , KR 20-2010-0003124 U, JP 07-043650 U and JP 11-244024 A.

* cited by examiner

CLASP

CROSS REFERENCE TO RELATED APPLICATIONS

This is a non-provisional application of International Patent Application No. PCT/US2012/063244, filed on 2 Nov. 2012, which claims the benefit of U.S. Provisional Application No. 61/628,740, filed on 4 Nov. 2011. All of said applications are herein incorporated by reference in their entirety.

FIELD OF THE INVENTION

The disclosure relates generally to a clasp, and more particularly to a springless clasp.

BACKGROUND OF THE INVENTION

Conventional bags, such as backpacks, often include multiple compartments and pockets for storing items. This configuration is often cumbersome, particularly when a user is not utilizing all or part of the storage space. One means of addressing the unused space is to have a bag with removable storage components. Conventional bags having removable storage components use attachment mechanisms for securing the storage components to the bag. Unfortunately, many of these attachment mechanisms are cumbersome and inefficient with regards to use, often making it harder to secure and remove the storage component than to use the bag with the excess compartments and storage pockets.

For example, storage compartments having zippers would require alignment of each side of the zipper and then the use of more than one hand to connect the storage compartment to the main bag body. Storage compartments employing a known clasp or clasps, typically with a spring, can also be inefficient to use in the sense that they often require two hands to operate.

Accordingly, a need exists for a clasp or springless clasp that can secure a first object to a second object with relative ease and speed. Moreover, the need exists for a clasp having a latch mechanism that can be operated with one hand.

SUMMARY OF THE INVENTION

Disclosed is a bag including a main bag body, and at least one bag pocket removably associable with said main bag body via at least one clasp, the clasp including a protrusion portion and a receiving portion, the protrusion portion including a protrusion configured to be received by a cavity defined by said receiving portion.

Also disclosed is clasp including a protrusion portion with a protrusion, a receiving portion defining a receiving cavity configured to receive the protrusion portion, wherein the protrusion is securable in the cavity via frictional fitting of the protrusion into the cavity, the frictional fitting of the protrusion into the cavity creating a secure association between the receiving portion and the protrusion portion, wherein the receiving portion includes a first arm and a second arm extending from a receiving portion base, the first arm including a first arcuate recess and the second arm including a second arcuate recess opposing the first arcuate recess, the first arcuate recess and the second arcuate recess defining an adjustable width of the cavity.

Still further disclosed is a clasp including a protrusion portion and a receiving portion, the protrusion portion including a protrusion configured to be received by a first cavity defined by the receiving portion, wherein the receiving portion includes a first arm and a second arm extending from a receiving portion base, the first arm including a first arcuate recess and the second arm including a second arcuate recess opposing the first arcuate recess, the first arcuate recess and the second arcuate recess defining an adjustable width of the first cavity, and a second cavity disposed adjacent the first cavity.

BRIEF DESCRIPTION OF THE FIGURES

The following descriptions should not be considered limiting in any way. With reference to the accompanying drawings, like elements are numbered alike.

DETAILED DESCRIPTION

Figure 1:
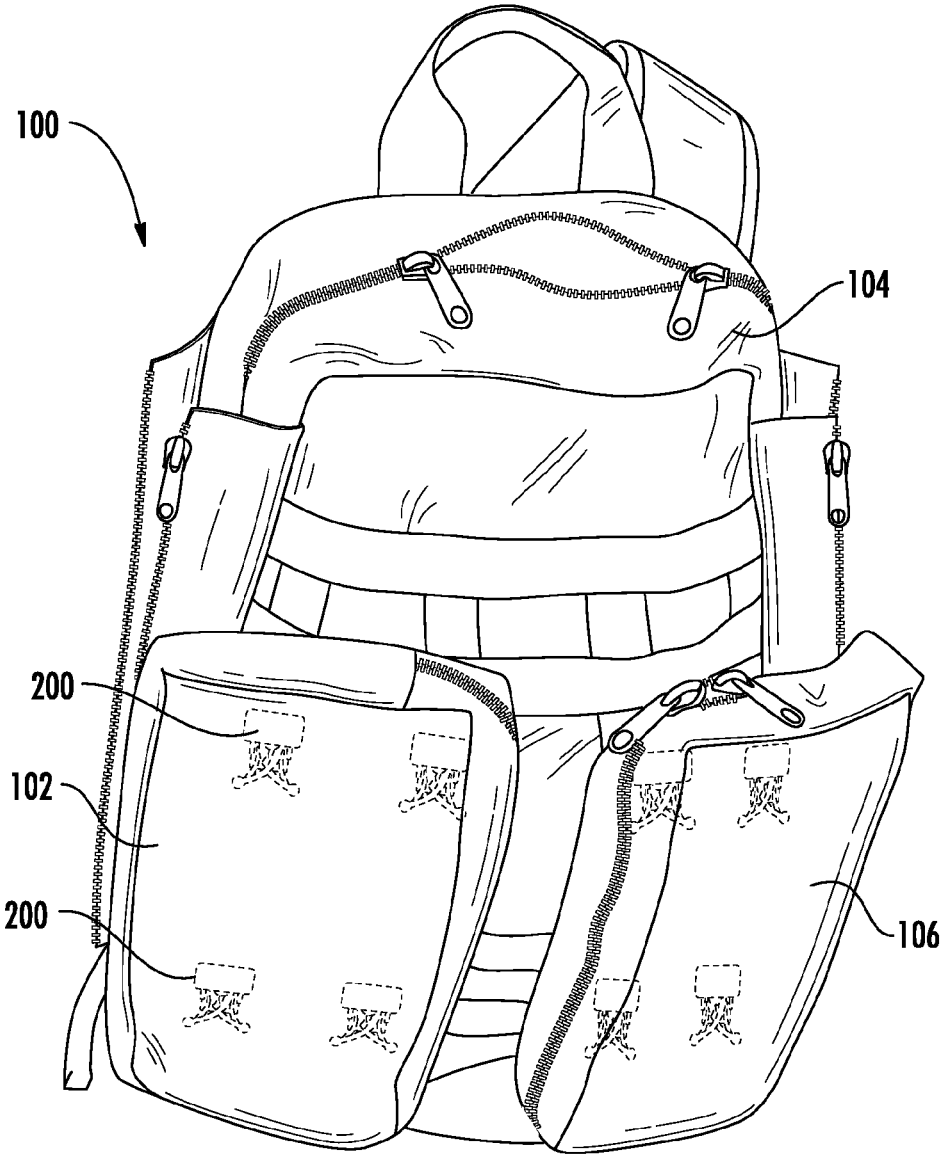
FIG. 1 is a front perspective view of a bag having at least one bag pocket attached with at least one clasp.
Figure 2:
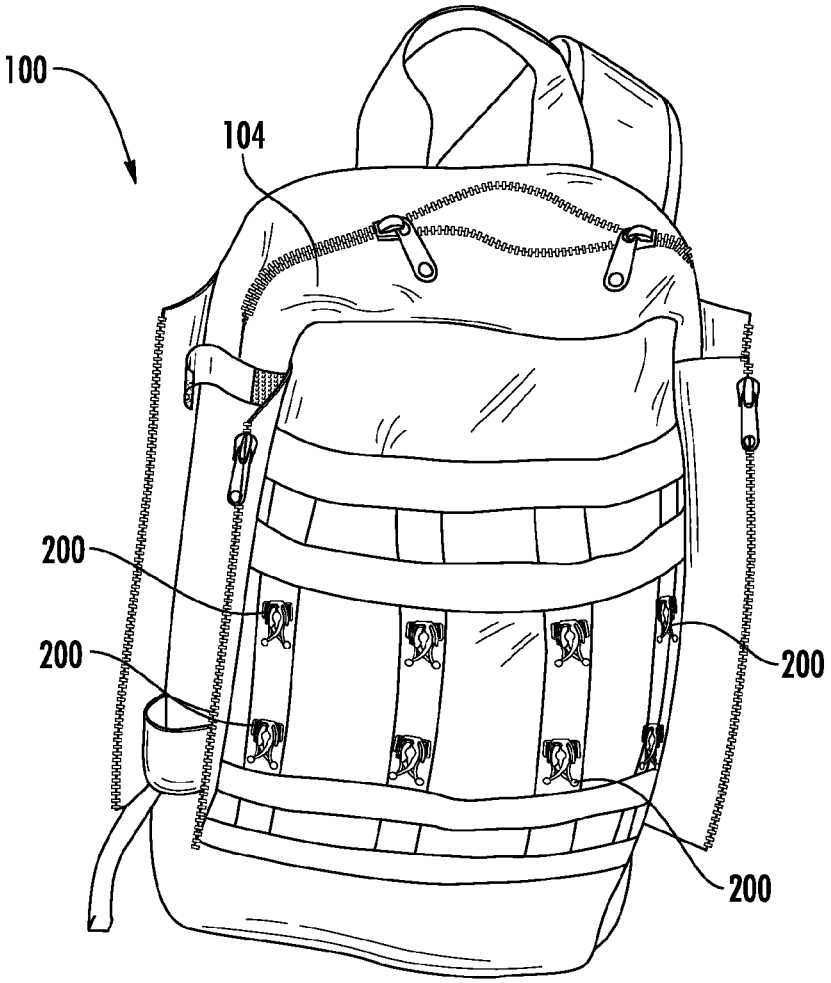
FIG. 2 is a front perspective view of the configurable bag of FIG. 1 with the at least one bag pocket having been removed.
Figure 3:
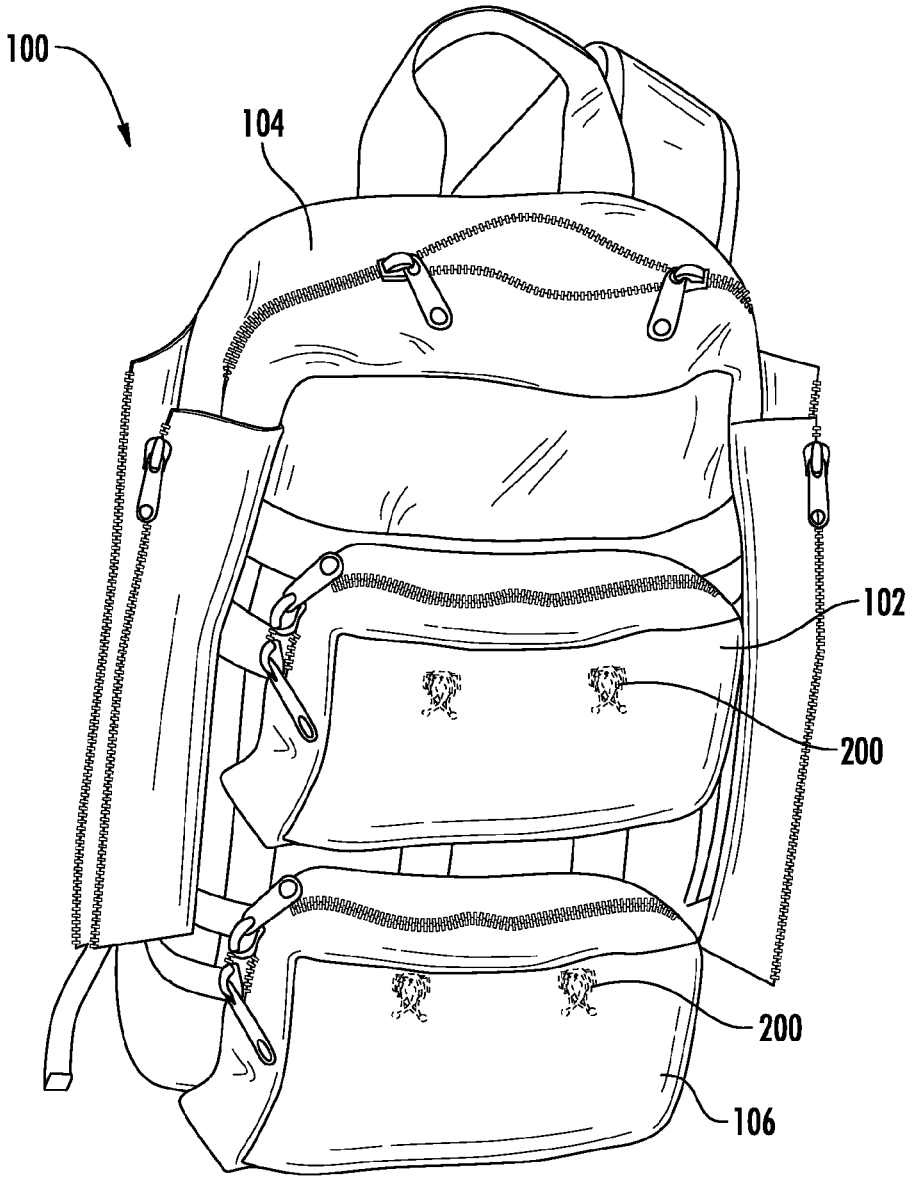
FIG. 3 is a front perspective view of the configurable bag of FIG. 1 with at least two bag pockets attached horizontally.

Referring to FIGS. 1-3, an exemplary embodiment of a configurable bag 100 having at least one bag pocket 102 removably associable therewith is illustrated. In this configuration, the bag 100 is a backpack and includes a main bag body 104 with a front panel and a back panel. The bag 100 includes at least one bag pocket 102 attached thereto with a springless clasp 200 as well as a second bag pocket 106 attached adjacent the first bag pocket 102, also with a springless clasp 200. As seen in FIG. 1, the bag pockets 102, 106 are aligned vertically, with long ends disposed essentially parallel to a longitudinal axis of the bag.

Referring to FIGS. 2 and 3, the bag pockets 102, 106 can be removed from the vertical alignment (FIG. 2) and can also be arranged horizontally (FIG. 3) with long ends disposed essentially orthogonal to the longitudinal axis of the bag, such that the first bag pocket 102 is disposed above the second bag pocket 106 by activating alternative clasps 200 variously placed along the front panel of the main bag body 104.

Referring to FIGS. 4-7, an example of a clasp 200 used to attach the bag pockets 102, 106 to the main bag body 104 are shown in greater detail. The clasp 200 includes a protrusion portion 202 and a receiving portion 204. The protrusion portion 202 includes a protrusion 206 configured to be received by a cavity 208 defined by the receiving portion 204. The protrusion 206 is circular and raised from the surface of the protrusion base 210. The protrusion 206 is securable in the cavity 208 by a frictional fitting of the protrusion 206 into the cavity 208. The frictional fitting of the protrusion 206 into the cavity 208 creates a secure association of the at least one bag pocket 102 to the main bag body 104.

As shown in the Figures, the protrusion 206 includes a major protrusion diameter 212 and a minor protrusion diameter 214. The cavity 208 of the receiving portion is slightly smaller (or perhaps the same) in width than the major diameter 212 and slightly larger in width than the minor diameter 214. The width of the cavity 208 relative to the respective lengths of the major protrusion diameter 212 and minor protrusion diameter 214 facilitate the frictional fitting discussed above. The cavity 208 expands to a first size larger than or equal to the major protrusion diameter 212 and closes to a second size substantially equal to the minor protrusion diameter 214 as the protrusion 206 is pushed through and into the cavity 208. In an exemplary embodiment, the minor protrusion diameter 214 is adjacent the protrusion base 210.

Figure 4:
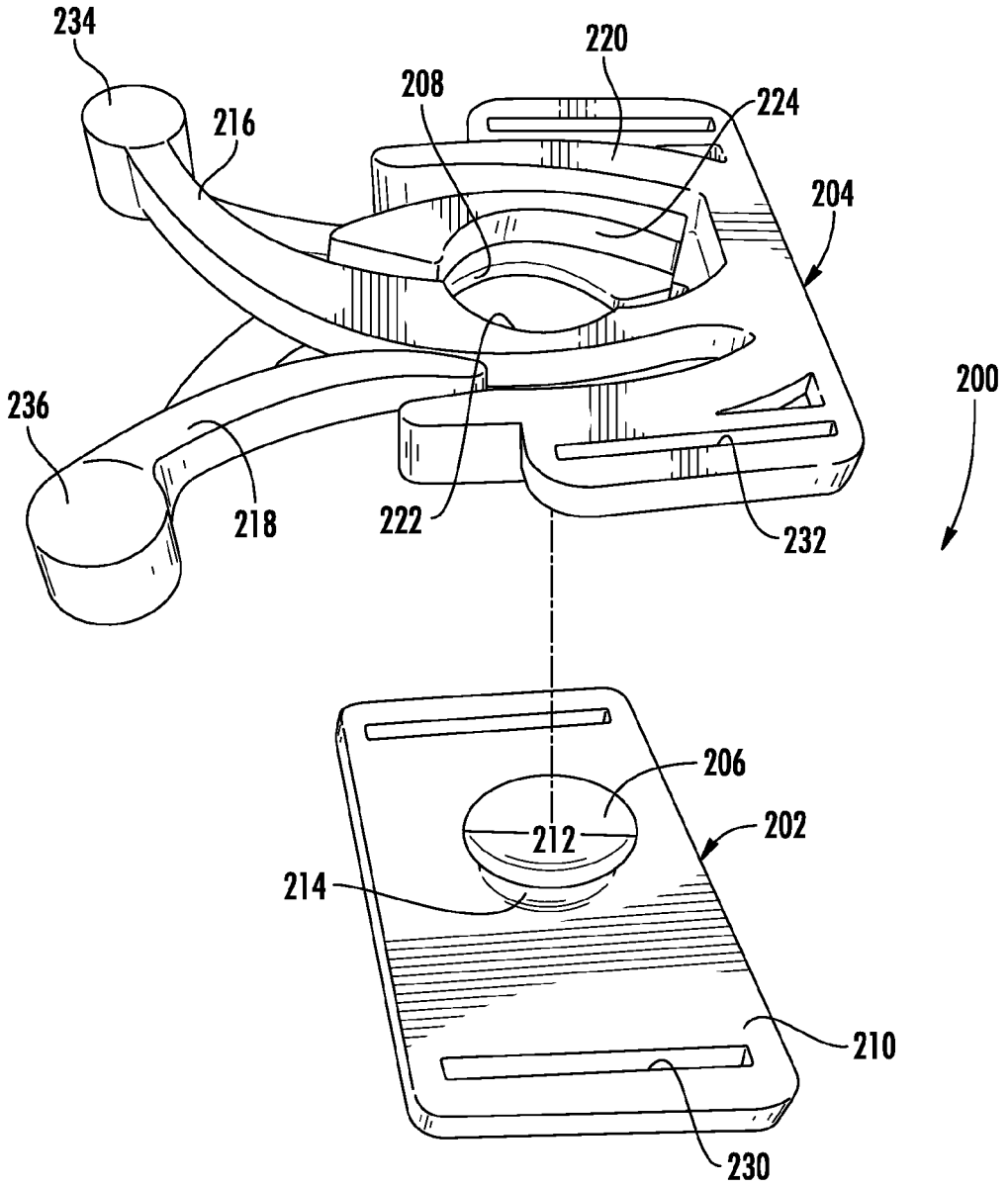
FIG. 4 is an exploded, front perspective view of the clasp in accordance with an exemplary embodiment.

As seen in FIG. 4, each receiving portion 204 includes a first arm 216 and a second arm 218 extending from a base 220 of the receiving portion 204. In an exemplary embodiment, portions of the first and second arms 216, 218 define the cavity 208. More specifically, the first arm 216 includes a first arcuate recess 222 and the second arm 218 includes a second arcuate recess 224 opposing the first arcuate recess 222. Each of the first and second arms 216, 218 could also include additional recesses wherein the third arcuate recess is adjacent the first arcuate recess 222 and the fourth arcuate recess is adjacent the second arcuate recess 224. The first and second arcuate recesses 222, 224 define the width of the cavity 208, which, as will be discussed in greater detail below, is adjustable via actuation of the arms 216, 218.

Figure 5:
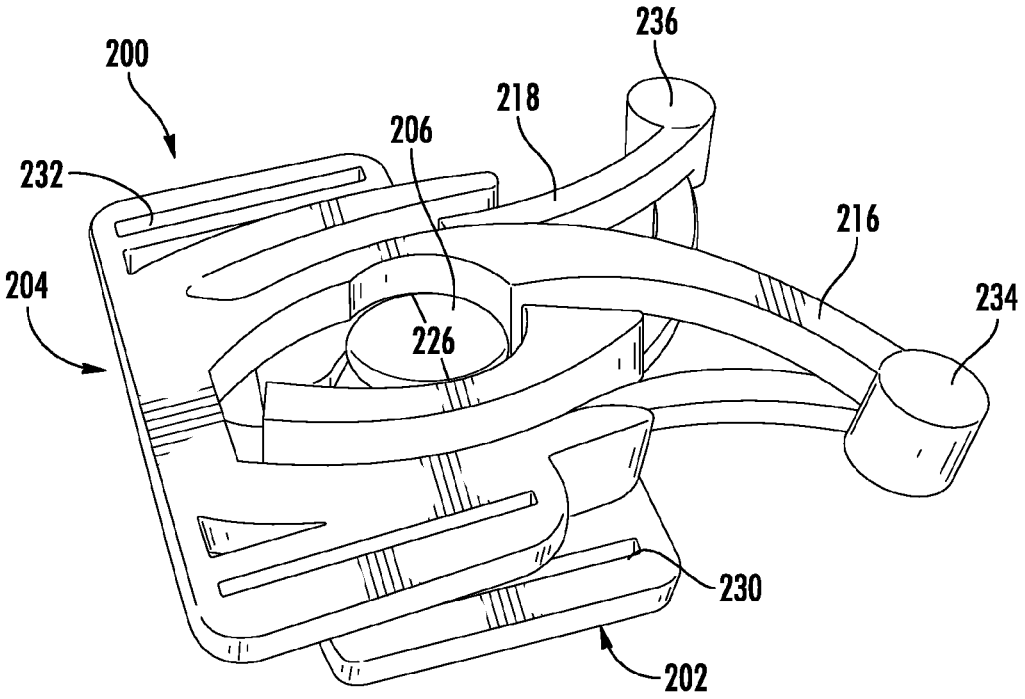
FIG. 5 is a front perspective engaged view of the clasp shown in FIG. 4.
Figure 6:
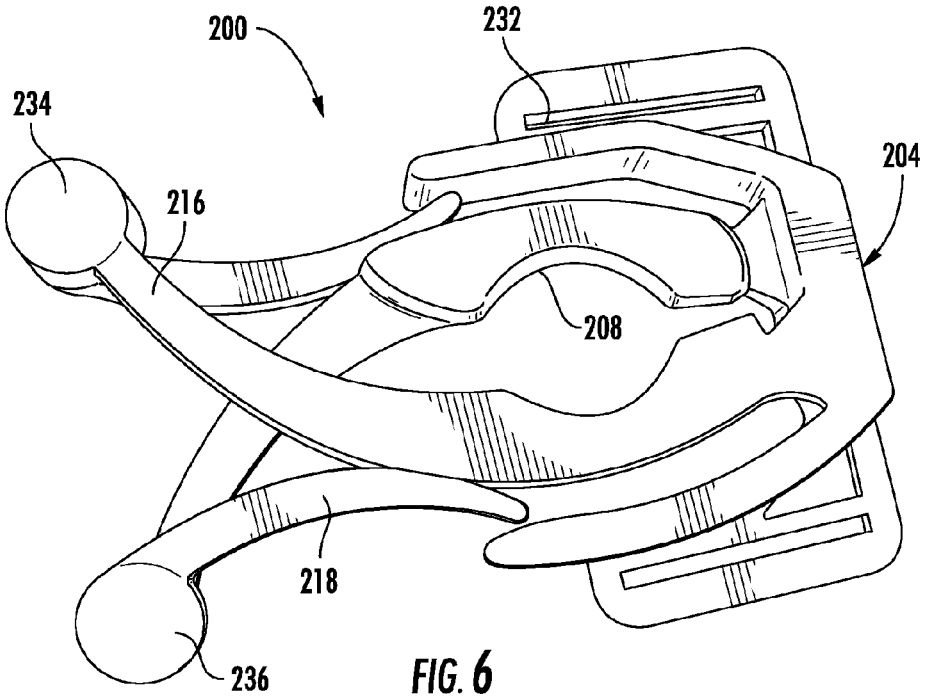
FIG. 6 is a top view of a receiving portion the clasp shown in FIG. 4 with first and second arms compressed.
Figure 7:
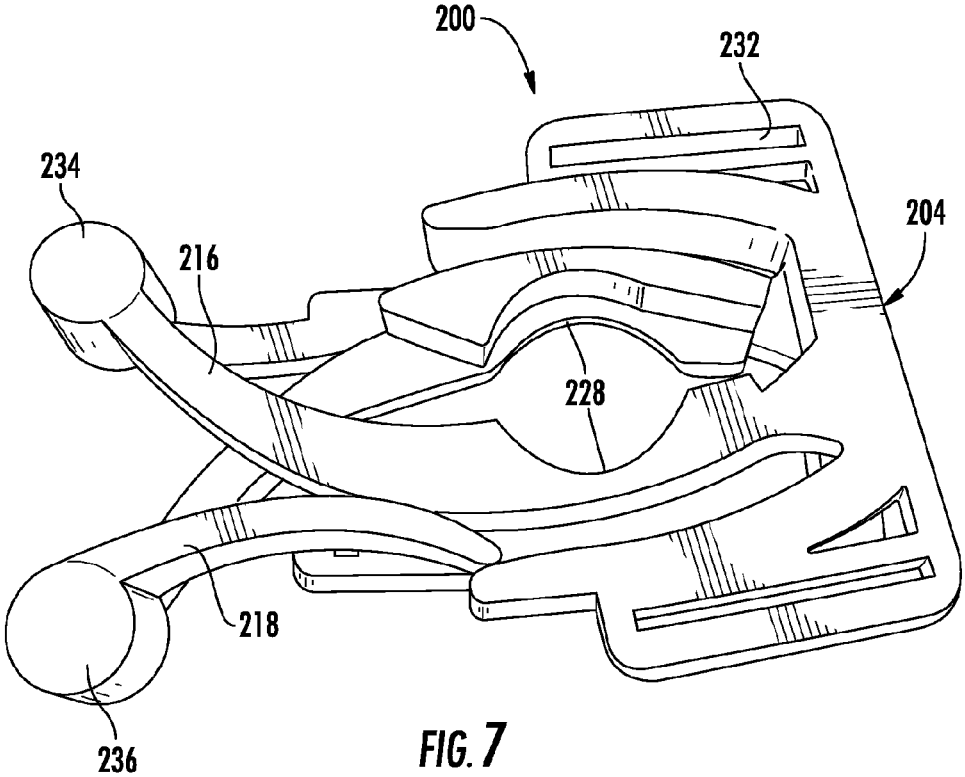
FIG. 7 is a bottom view of the receiving portion of the clasp shown in FIG. 6.

The cavity 208 includes a first width 226, as seen in FIG. 5, when the first and second arms 216, 218 are disposed in a resting position (as is also shown in FIG. 4). The first width 226 is adjustable into a second width 228, as seen in FIG. 7, when a compressing force is applied to the first arm 216 and the second arm 218 such that a distance between the furthest extents 234 and 236 of the first arm 216 and second arm 218 is decreased. The second width 228 of the cavity 208 is greater than the first width 226 of the cavity 208, and perhaps more importantly, the second width 228 is greater than the major protrusion diameter 212 so as to allow the protrusion 206 to be released from the cavity 208 via a compressive force applied to the first arm 216 and the second arm 218.

As seen in FIG. 4, the first arm 216 is horizontally and vertically displaced from the second arm 218 such that the first arm 216 is biased against the second arm 218 and the second arm 218 is biased against the first arm 216.

When the first arm 216 and second arm 218 are released and the user disengages the extents 234, 236, the second width 228 of the cavity adjusts into the first width 226 to secure the protrusion 206. The clasp 200 and its components may be made of a resilient plastic or metal material having a tendency to create a spring effect allowing the arms 216, 218 to easily move between compressed and released positions.

The protrusion portion 202 is affixed to a first object or a second object such as the main bag body 104 or to the at least one bag pocket 102 via a sewing, adhering, or strapping of the protrusion portion 202 to the first object or the second object such as the main bag body 104 or the at least one bag pocket 102. The receiving portion 204 is affixed to a first object or a second object such as the main bag body 104 or the at least one bag pocket 102 via a sewing, adhering, or strapping of the protrusion portion 202 to the first object or the second object such as the main bag body 104 or the at least one bag pocket 102.

As seen in FIG. 4, the protrusion portion 202 may also include at least one strap slot 230. The strap slot 230 is configured for receiving a strap or similar attachment element and affixing the protrusion portion 202 to at least one strap associated with a first object or a second object such as the main bag body 104 or the at least one bag pocket 102. Additionally, the receiving portion 204 may also include at least one strap slot 232. This strap slot 232 is also configured for receiving a strap or similar attachment element and affixing the protrusion portion 204 to at least one strap associated with the first object or the second object such as the main bag body 104 or the at least one bag pocket 102. The strap slots 230, 232 can be used for sewing or similarly attaching the protrusion portion 202 and/or receiving portion 204 to the main bag body 104 or the at least one bag pocket 102. While the illustrated strap slots 230, 232 are rectangular shaped, they could be any shape that would accommodate attachment to a related device.

As illustrated in FIGS. 1 and 3, an additional feature of the clasp 200 is the ability to connect the at least one bag pocket 102 in a vertical or horizontal orientation. Turning to FIG. 1, the bag pockets 102 are disposed vertically with respect to the longitudinal axis of the bag 100. As seen in FIG. 3, the bag pockets 102 are disposed horizontally with long ends disposed essentially perpendicular to the longitudinal axis of the bag. This is accomplished with the plurality of clasps 200. Specifically, one of the receiving portions 204 or protrusion portions 202 are embedded in the main bag body 104 and the other of the protrusion portions 202 or receiving portions 204 are secured to the bag pockets 102.

As seen in FIG. 2, the clasps 200 are evenly spaced along the main bag body 104 to account for the bag pockets 102 being disposed horizontally or vertically depending on which receiving portions 204 are engaged by the protrusion portions 202 (and vice versa).

Figure 8:
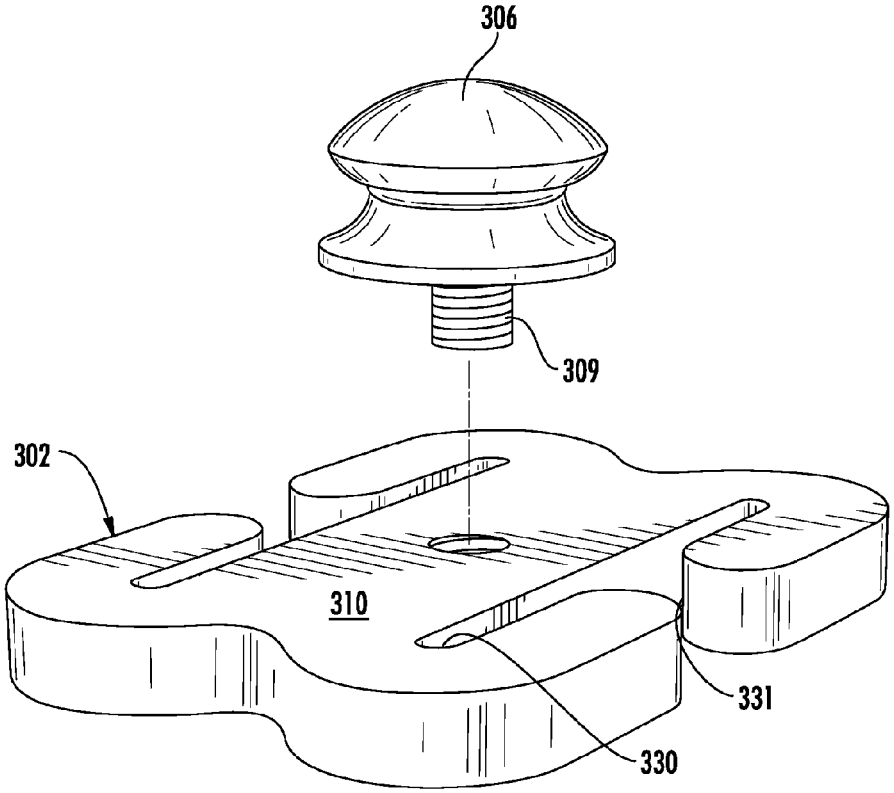
FIG. 8 is an exploded, front perspective view of a protrusion portion of a clasp according to another embodiment.

Referring to FIG. 8, another embodiment of a protrusion portion 302 will now be discussed. The protrusion portion 302 includes the same or similar features and configurations as that of portion 202, except where otherwise noted. In this embodiment 302, the protrusion 306 is removably associated with the protrusion base 310. In an exemplary embodiment, this removable association is accomplished via a screw 309 or other threaded attachment mechanism extending from the protrusion 306 and being threadable into the base 310. Via this embodiment, the protrusion 306 can be removed from the base 310 and threadingly attached to a device with a corresponding thread receiving cavity (i.e., camera, mobile phone case, or the like). Thereby, the protrusion 306 could be received in a cavity 308 of a corresponding receiving portion 304 in order to attach such a device. Of course, other attachment features besides thread association, such as but not limited to snaps, hook and loop material, adhesion, and other frictional fits, may also be used to removably associate the protrusion 306 with the base 301.

Figure 9:
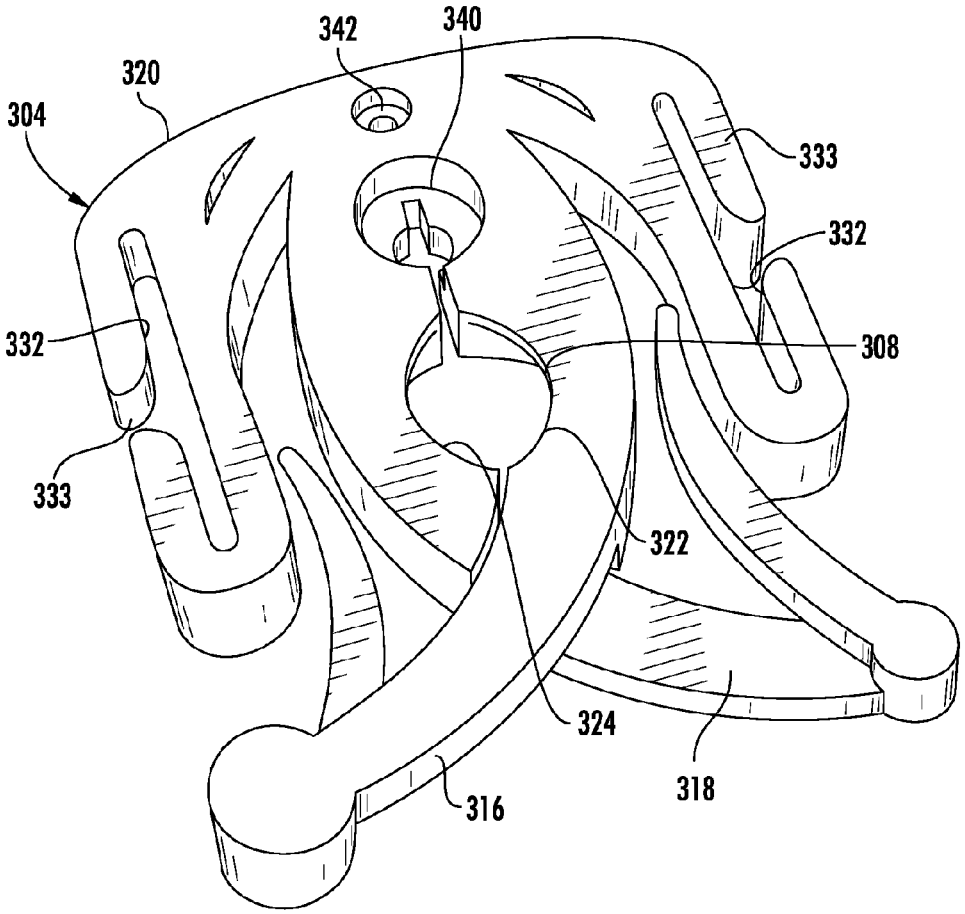
FIG. 9 is a top view of a receiving portion of the clasp according to another embodiment.
Figure 10:
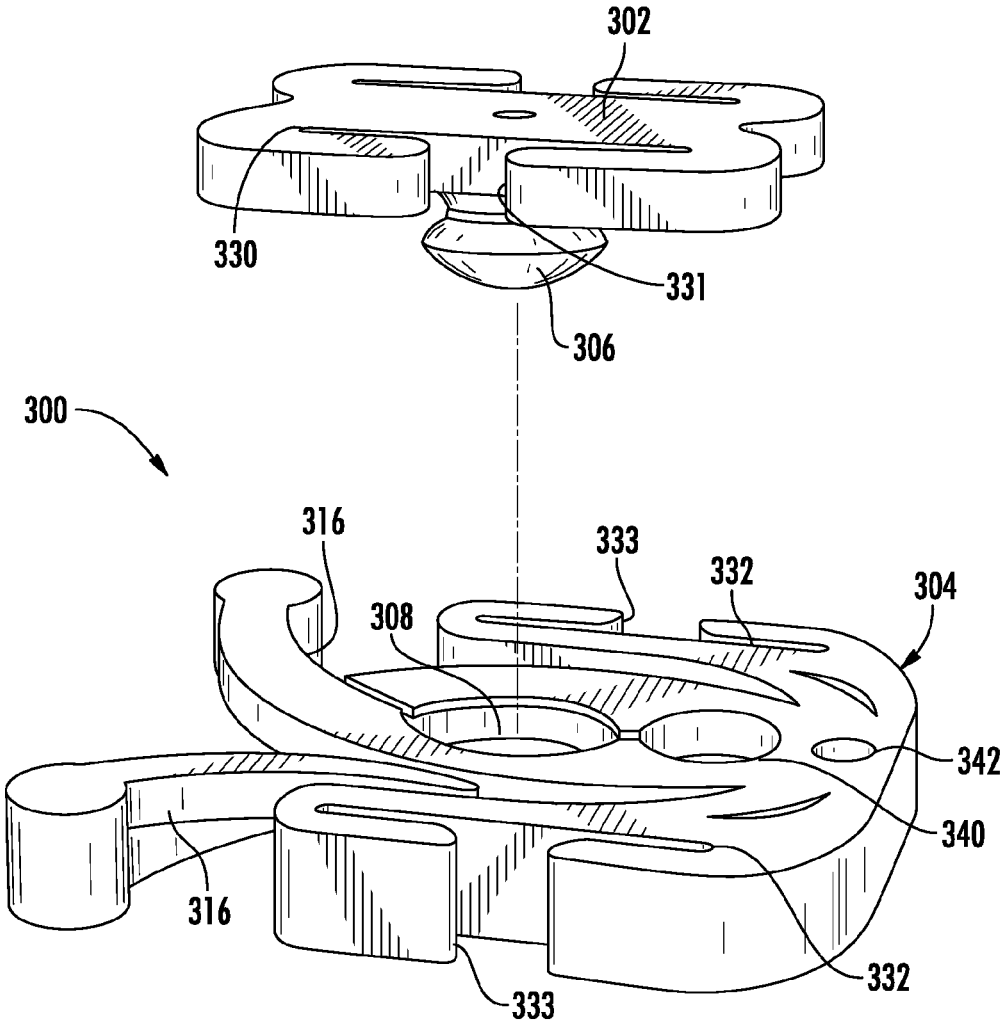
FIG. 10 is a side, exploded view of the clasp according to another embodiment.
Figure 11:
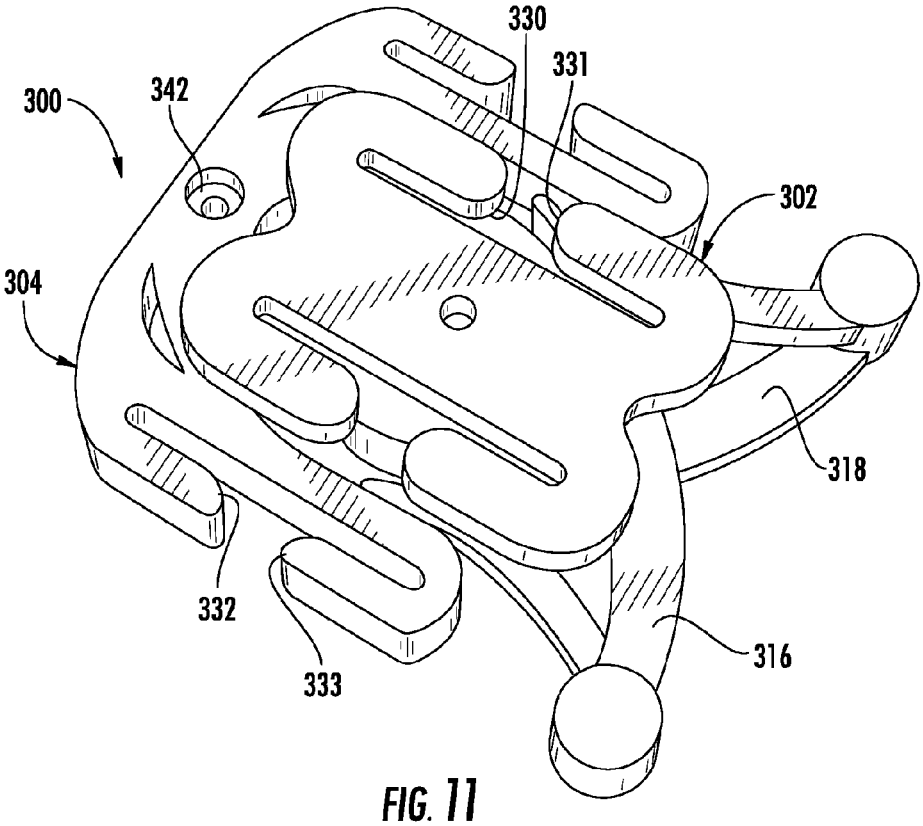
FIG. 11 is a top, perspective view of the clasp according to the another embodiment with the protrusion portion and the receiving portion engaged.

Referring to FIGS. 9-11, a full clasp 300 (showing the protrusion portion 302 by way of example, though any protrusion portion discussed herein may be used) including a receiving portion 304 is shown. As with the above discussed protrusion portion 302 this receiving portion 304 includes the same or similar features and configurations as that of portion 202, except where otherwise noted.

The receiving portion 304 in this exemplary embodiment includes a second cavity 340 in addition to and disposed adjacent the first cavity 308 (please see FIG. 9). The second cavity 340 is used in connection with a first attachment mechanism, such as a nail, for attaching the receiving portion 304 to a first object, such as a wall. Optionally, the receiving portion 304 can be rotated around the axis of the first attachment mechanism if a user intends to reposition the receiving portion 304. Thus, the clasp 300 can be used to mount an object on the first object, such as hanging a picture on a wall.

The clasp receiving portion 304 further includes a third cavity 342 disposed adjacent the second cavity 340. The third cavity 342 is used in connection with a second attachment mechanism, such as a nail, for securing the receiving portion 304 to the first object, such as the wall. The third cavity 342 is used for stabilizing the receiving portion 304 to prevent the receiving portion from spinning around the axis of the first attachment mechanism.

As illustrated in the exemplary embodiments of FIGS. 8-11, the protrusion portion 302 includes at least one strap slot 330 with a C-shaped configuration, and the receiving portion 304 also includes at least one strap slot 332 with a C-shaped configuration. These C-shaped configurations are formed via perpendicular openings 331 and 332, which communicate respective slots 330 and 332 the ambient environment disposed laterally to the clasp 300. These C-shaped configurations allows straps to be pinched or squeezed together and received in the respective slots 330 and 332 in either the receiving portion 304 or the protrusion portion 302.

While the invention has been described with reference to an exemplary embodiment, it should be understood by those skilled in the art that various changes may be made and equivalents may be substituted for elements thereof without departing from the scope of the invention. In addition, many modifications may be made to adapt a particular situation or substance to the teachings of the invention without departing from the scope thereof Therefore, it is important that the invention not be limited to the particular embodiment disclosed as the best mode contemplated for carrying out this invention, but that the invention will include all embodiments falling within the scope of the apportioned claims. Moreover, unless specifically stated any use of the terms first, second, etc. do not denote any order or importance, but rather the terms first, second, etc. are used to distinguish one element from another.

What is claimed is:

1. A clasp comprising: a protrusion portion including a protrusion; a receiving portion defining a receiving cavity configured to receive said protrusion portion, wherein said protrusion is securable in said cavity via frictional fitting of said protrusion into said cavity, said frictional fitting of said protrusion into said cavity creating a secure association between said receiving portion and said protrusion portion, wherein said receiving portion includes a first arm and a second arm extending from a receiving portion base, said first arm including a first arcuate recess and said second arm including a second arcuate recess opposing the first arcuate recess, said first arcuate recess and said second arcuate recess defining an adjustable width of said cavity.

2. The clasp of claim 1, wherein each of said first arm and said second arm include a furthest extent from said receiving portion base, wherein said cavity includes a first width when said first arm and said second arm are in a rest position, said first width being adjustable into a second width when a compressing force is applied to said first arm and said second arm such that a distance between said furthest extents of said first arm and said second arm is decreased, and wherein said second width of said cavity is greater than said first width of said cavity.

3. The clasp of claim 2, wherein said protrusion includes a major protrusion diameter and a minor protrusion diameter, and wherein said second width of said recess is greater than said major diameter of said protrusion so as to allow said protrusion to be released from said recess via said compressive force applied to said first arm and said second arm.

4. The clasp of claim 1, wherein said protrusion portion includes at least one strap slot configured to affix said protrusion portion to at least one strap.

5. The clasp of claim 1, wherein said receiving portion includes at least one strap slot configured to affix said receiving portion to at least one strap.

6. The clasp of claim 1, wherein said protrusion portion includes a protrusion base and said protrusion, said protrusion being removably associated with said protrusion base.

7. The clasp of claim 1, wherein said protrusion is removably associated with said protrusion base via threaded association.

8. The clasp of claim 1, wherein said strap slot includes a substantially C-shaped configuration.

9. The clasp as claimed in claim 5, wherein said strap slot includes a substantially C-shaped configuration.

* * * * *